US005111938A

United States Patent [19]

Soprano et al.

[11] Patent Number: 5,111,938

[45] Date of Patent: May 12, 1992

[54] SOLID WASTE CONTAINER

[75] Inventors: Toby L. Soprano, Floral Park; Benjamin J. Scolavino, Chester; Albert N. Caro, Essex Falls; Robert A. Angione, Emerson, all of N.J.

[73] Assignee: Segri-Gator Associates L.P., Montville, N.J.

[21] Appl. No.: 595,865

[22] Filed: Oct. 12, 1990

[51] Int. Cl.[5] ..... B65D 81/20

[52] U.S. Cl. ..... 206/386; 206/459; 206/524.8; 206/597; 220/371

[58] Field of Search ..... 206/386, 459, 595-600, 206/524.8; 220/1.5, 209, 371, 373, DIG. 15, DIG. 16

[56] References Cited

U.S. PATENT DOCUMENTS

| | | | |
|---|---|---|---|
| 2,279,155 | 4/1942 | Wright | 220/DIG. 16 |
| 2,314,963 | 3/1943 | Zelnis | 220/373 |
| 2,429,958 | 10/1947 | Liebmann . | |
| 2,656,090 | 10/1947 | Hamblet . | |
| 2,695,115 | 11/1954 | Roop . | |
| 3,476,287 | 11/1964 | Kinnavy . | |
| 3,618,814 | 11/1969 | Nagroski . | |
| 3,620,409 | 11/1971 | Rosenbaum | 206/524.8 |
| 3,753,731 | 8/1973 | Christ . | |
| 3,759,416 | 9/1973 | Constantine . | |
| 3,943,987 | 3/1976 | Rossi | 206/524.8 |
| 4,093,009 | 6/1978 | Iavarone et al. | 206/524.8 |
| 4,218,967 | 8/1980 | Batchelor | 206/524.8 |
| 4,416,374 | 11/1983 | Smith et al. . | |
| 4,434,891 | 3/1984 | Skinner et al. | 206/524.8 |
| 4,637,919 | 1/1987 | Ryder et al. | 220/371 |
| 4,643,314 | 2/1987 | Kidd | 206/386 |
| 4,722,451 | 2/1988 | Conrad | 206/524.8 |
| 4,756,425 | 7/1988 | Wise . | |
| 4,765,480 | 8/1988 | Malmanger . | |
| 4,838,443 | 6/1989 | Cripe et al. | 220/1.5 |
| 4,848,580 | 7/1989 | Wise . | |

OTHER PUBLICATIONS

Microclean Environmental Transport System. Rotonics Molding Inc., Chicago.

*Primary Examiner*—Jimmy G. Foster

*Attorney, Agent, or Firm*—McAulay Fisher Nissen Goldberg & Kiel

[57] ABSTRACT

A solid waste container has a container body with an open top which accepts a removable lid. The container also has a passage for evacuating air from within the container through a filter disposed at an inboard end of the passage. A check valve prevents air from re-entering the container through the passage. The container optionally includes integrally formed grooves for strapping the lid to the container, slots for allowing transport and handling using a fork truck, and handles for hand manipulation. Utilizing an evacuated container for transporting solid waste such as asbestos, prevents the discharge of particulates from the containers during handling and transport and thus, reduces the potential for exposure to such substances.

12 Claims, 4 Drawing Sheets

SOLID WASTE CONTAINER

TECHNICAL FIELD

This invention relates to sealable solid waste transport containers, and more particularly to waste containers for transporting asbestos or similar solid waste materials.

BACKGROUND OF THE INVENTION

Solid waste is typically transported by truck from a generating facility to a disposal site, with non-hazardous materials typically transported in bulk containers. The transportation and handling of solid hazardous waste poses a special problem, due to the potential exposure to those loading, transporting and unloading the trucks hauling the waste. For example, asbestos is typically double-bagged in plastic to prevent the release of asbestos fibers into the air during handling transportation and storage. However, such bags may tear and cause a release of asbestos fibers. While protective gear is typically worn, it is preferable to prevent any release to avoid contaminating not only the worker but the truck interior, waste generating or waste disposal facility. In addition, such bags, having no structural integrity, tend to shift during transportation increasing the potential for tearing. They are also difficult to handle and store.

SUMMARY OF THE INVENTION

It is an object of the present invention to provide a solid waste container which allows ease in handling and storage of solid waste material.

It is a further object to provide a solid waste container which is sealable to prevent any inadvertent release of the material contained therein.

It is a further object to provide a solid waste container which may be put under vacuum such that if a leak develops, air leaks into rather than out of the container.

It is yet another object to provide a solid waste container that is stackable and sealable to maximize storage capacity.

These and other objects of the present invention are achieved by providing a solid waste container comprising a container body, having an open top, lid means removably disposable on the top of said container, the lid means including a passage, filter means disposable on an inboard side of the passage, and reverse flow prevention means disposed within or on the outside of the passage, for allowing withdrawal of air from the container. Utilizing such a container assures that any leaks which develop will draw air into the container rather than cause discharge of possibly contaminated air out of the container.

In a preferred embodiment, the container lip has an inner lid seal adhesively applied for sealing the lid to the container. The container and lid have integral structures, such as legs and receiving sockets for stacking and other integral structures for lifting and transportation by fork truck or hand truck. Optionally, the container may have straps for binding the lid to the container or binding adjacent containers to each other.

DETAILED DESCRIPTION OF THE INVENTION

Figure 1:
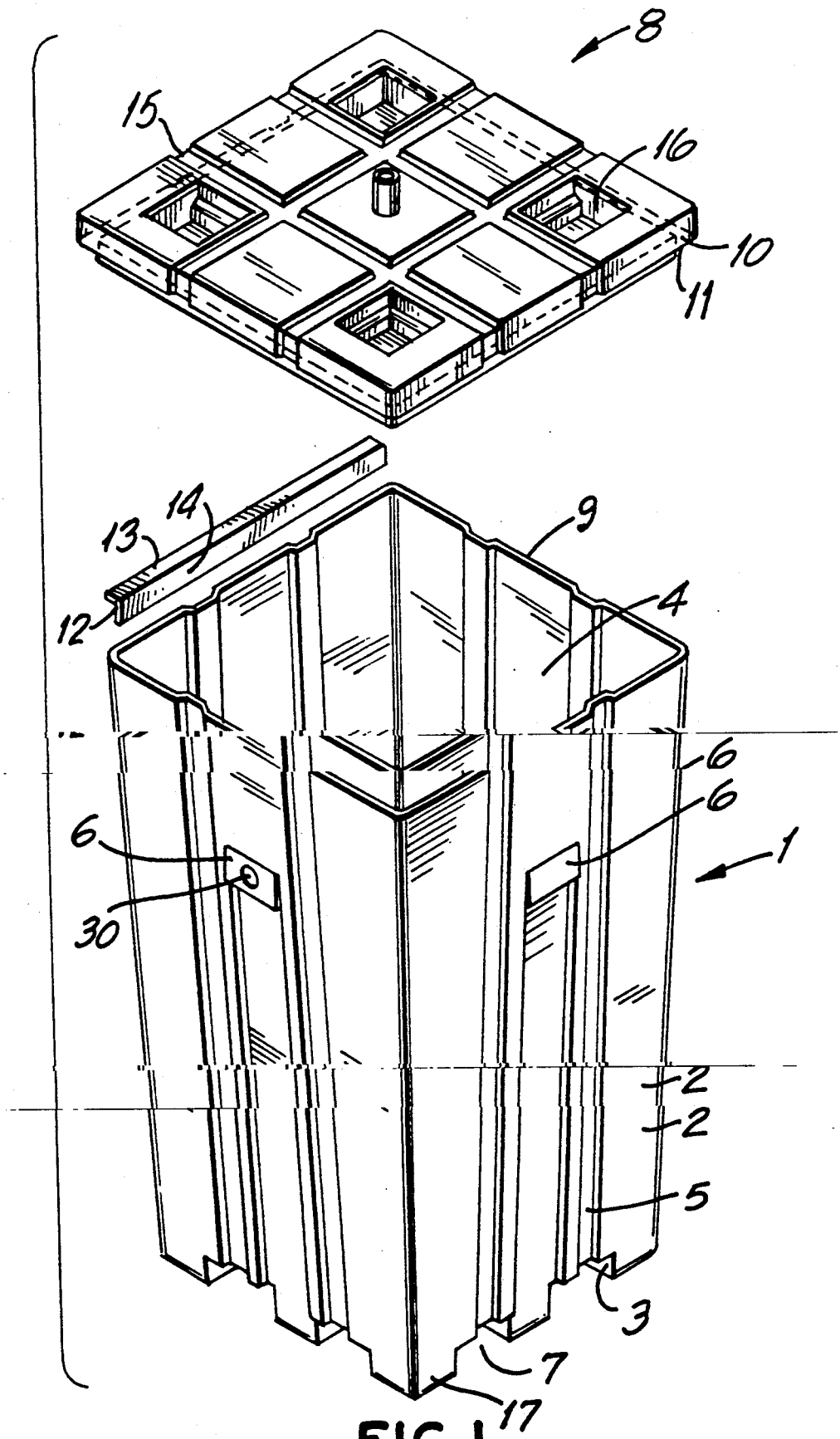
FIG. 1 is a perspective view of the waste container of the present invention.
Figure 2A:
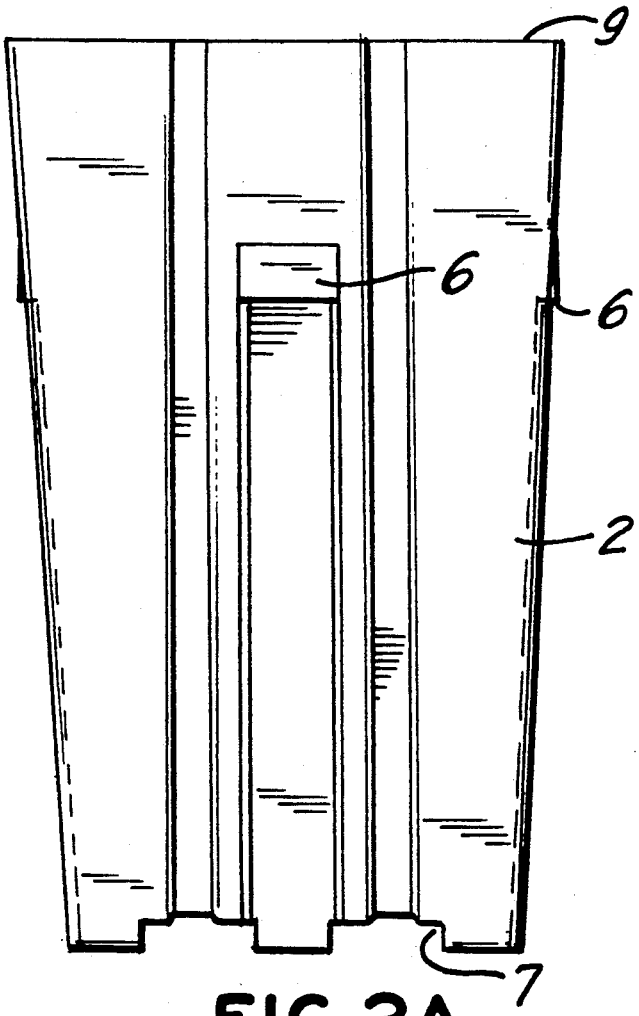
FIG. 2*a* is a side view and FIG. 2*b* is a bottom view of the container of FIG. 1.
Figure 2B:
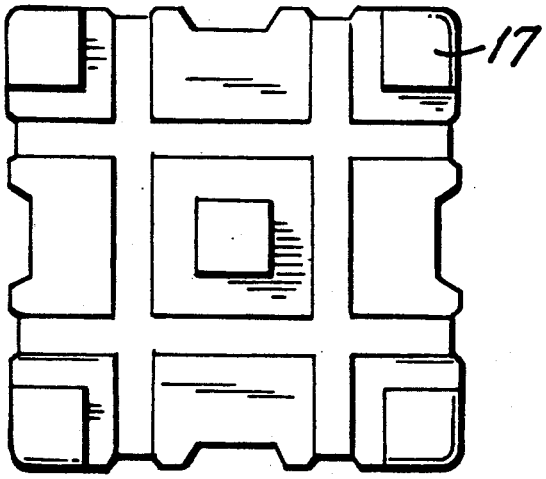

Referring to FIGS. 1, 2*a* and 2*b*, a container 1 has sidewalls 2, a bottom 3 and an open top 4. The container sidewalls are preferably tapered to allow multiple containers to be stacked when full or nested when empty. The sidewalls and bottom have grooves 5 for accepting straps or banding for securing the containers. Each sidewall has a pair of such grooves, and each has a handle 6 for manual manipulation of the container. The container 1 also has slots 7 formed in the bottom of the container. These slots are sized to accept the forks from a hand truck or fork truck.

The container is preferably composed of a plastic material such as polyethylene, polyvinylchloride, nylon, polycarbonate or polyesters. Of course, other materials such as polystyrene, polyurethane, polypropylene, polybutylene, etc. could be used. Preferably, the container body and lid are molded using a rotomolding technique, which assures proper detail molding. Of course, other methods of molding such as injection molding could also be used.

A lid 8 is provided for mating with a lip 9 on the top of the container. The lid has a flange 10 which extends over the container lip and has a surface 11 for engaging the lip to seal the container. Once mated, an air tight seal is obtained.

While with some plastics, the lid to container seal is achieved directly, it is preferable to use a seal placed between the lid and container. Referring still to FIG. 1, an L-shaped seal 12 is used which preferably extends around the entire container lip 9. A portion 13 of the seal rests on top of the lip and a portion 14 rests against the inner surface of the sidewall. The seal may be composed of rubber, foam or another resilient material and be adhesively attached to either the container or lid to avoid shifting.

Figure 6:
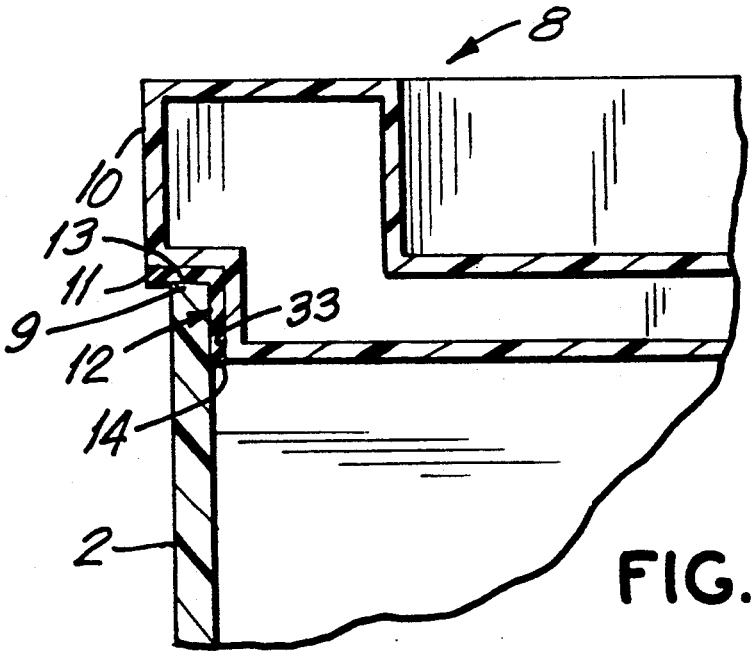
FIG. 6 is an enlarged view showing the lid to container seal.
Figure 7A:
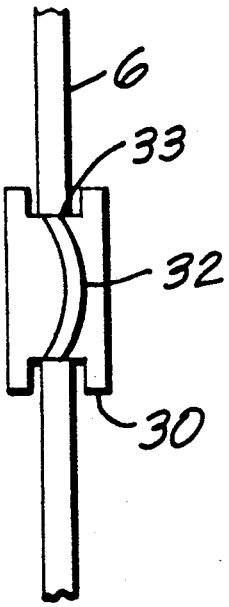
FIGS. 7*a* and 7*b* are enlarged sectional views of the pressure sensing grommet.
Figure 7B:
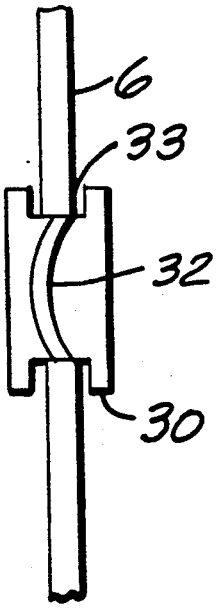

Referring to FIG. 6, the lid to container seal is shown. The lid surface 11 engages the seal portion 13 which rests on the lip 9. The seal portion 14 is sandwiched between the sidewall 2 and a vertical lid surface 33. This L-shaped seal assures that the container has an airtight seal.

Figure 3:
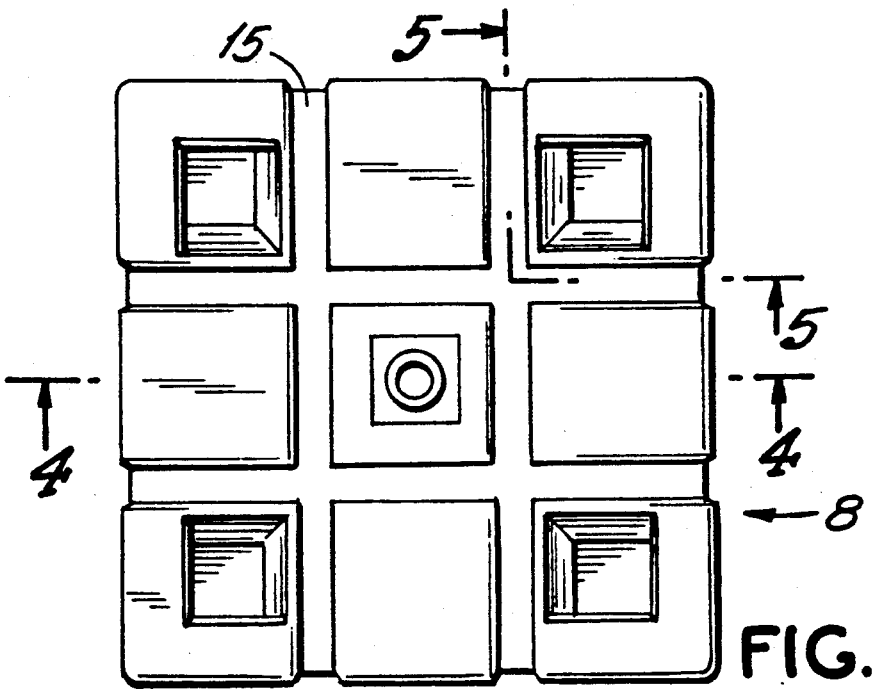
FIG. 3 is a top view of the container lid.

The lid 8 also has grooves 15, best seen in FIG. 3, which are aligned with the corresponding grooves 5 on the sidewalls of a container for strapping. Preferably the grooves are about 1½" wide for accepting up to a 1½" wide banding material, such as nylon strapping. Thus, the lid can be strapped to the container. Optionally, precut and sized straps may be attached at one end to the lid by rivets or other means to avoid the necessity of handling bulk strapping.

The lid 8 also has sockets 16 for accepting the legs of another container for stabilized stacking. Four sockets 16 are provided to accept legs or projections 17 molded on to the bottom of the container (see FIG. 2*b*). Consequently, secure stacking can be achieved to prevent shifting during transportation.

Figure 4:
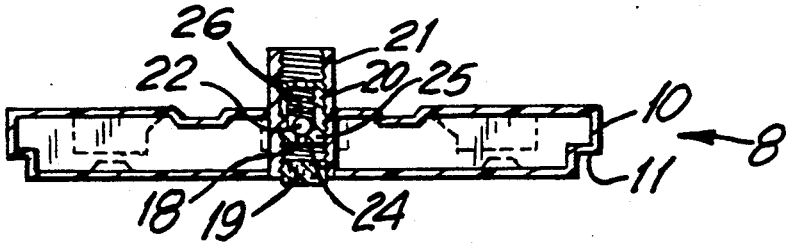
FIG. 4 is a cross sectional view of the lid taken along line 4—4 of FIG. 3.

Referring to FIG. 4, the container lid 8 includes a passage 18 having a filter element 19 at its inboard entrance end within the container. A check valve 20 is disposed adjacent to the outlet end of the passage. A threaded fitting 21 is provided for connecting a vacuum source to the passage. The passage is threaded to allow ease in attaching the filter element and check valve, which are similarly threaded, to the passage.

The check valve is a conventional flow reversal prevention devise positioned to allow fluid flow out of the container but not to allow fluid flow back into the container. This maintains a negative pressure in the container after disconnection from the vacuum source. The check valve 20 has a ball 22 positioned between a seal 24 and a seat 25, with the ball biased into engagement with the seal 24 by a spring 26. By connecting a vacuum source to the passage, the spring pressure is overcome, unseating the ball and allowing evacuation of the container. After disconnection, the spring forces the ball against the seal to prevent air flow back into the container, maintaining a negative pressure within the container. Of course, a simple block valve could be used to prevent flow back into the container, but this typically requires operator attention and is not preferred. While a ball type check valve is shown, a flap check, collapsible elastomer check or other type check valve could also be used.

The filter element 19 is preferably a high efficiency particulate air (HEPA) filter medium which removes five micron particles at 99 plus percent efficiency. For example, various HEPA filter cartridges sold by Lab Safety Supply Co., such as no. RA-11299, RA-7576 or RA-3202 could be used. Thus any air removed from the container after it has been filled with a solid waste material is filtered to prevent discharge of any particulates to the atmosphere.

The container is used as follows. The lid is removed and a solid waste material is placed in the container. The lid is then added and straps placed in the grooves to hold the lid to the container. A vacuum source is then connected to the threaded fitting on the end of the passage, and internal container air is drawn through the filter and check valve to the vacuum source to create a negative pressure in the container. Since the air is filtered, it can be discharged from the vacuum source without fear of discharging harmful particulates. Thus, a conventional vacuum source, such as a vacuum cleaner, can be used without requiring container evacuation in a containment area. After the vacuum source is removed, the airtight seal between the lid and container assures that the negative pressure in the container is maintained.

Figure 5:
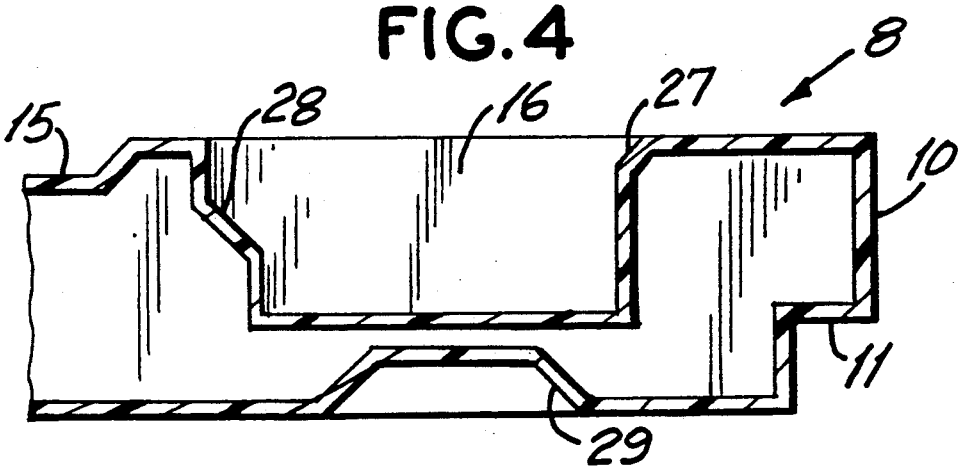
FIG. 5 is an enlarged sectional view of the lid taken along line 5—5 of FIG. 3.

Referring to FIG. 5, an enlarged sectional view of the lid socket 16 is shown. The socket 16 is generally rectangular to accept a container leg therein. The socket has tapered portions 27 and 28 to ease entrance of the container leg without binding. A truncated cone 29 is formed beneath the socket to strengthen the socket and increase stability. These containers may weigh as much as 400 lbs when full, and the lid must be of sufficient strength to support such a weight. Preferably, the lid is formed by rotomolding which provides a hollow structure, as shown, allowing the integration of strengthening structures such as the truncated cones in the lid.

Pressure sensor means are preferably provided to indicate whether the container is under vacuum. Referring to FIGS. *7a* and *7b*, a grommet 30 is disposed in an opening 31 in the handle 6. The grommet 30 has a resilient deformable membrane 32, which, when vacuum is pulled in the container, is drawn inwardly to indicate that the container is under vacuum (FIG. *7a*). When no vacuum is acting on the membrane, it remains in its neutral outward position (FIG. *7b*). The sensitivity of the membrane may be adjusted by varying the membrane thickness. Typically, the membrane is made from a material such as Buna-N, and either convex or concave, depending on whether vacuum is provided within the container. Thus, at a glance, an operator can determine if the container seal integrity has been maintained during transport or if a leak has occurred. If a more sophisticated pressure sensor is desired, a conventional analog or digital pressure indicating gauge could be used. Of course, the gauge or grommet may be placed on either the lid or container.

Utilizing the inventive solid waste container to store and transport a solid waste material such as asbestos limits exposure and discharge of fibers possible with the prior art double-bag system. In addition, the containers are stable and sized for efficient stacking in a truck or warehouse. Maintaining the containers with a negative pressure minimizes the potential release of waste materials as leaks cause air to enter rather than leave the container. Such containers, being of essentially unitary construction, are easily fabricated with integral structures for handling by fork trucks or hand trucks. Thus a low cost container of high integrity is provided which minimizes the transport and storage problems previously encountered when handling solid waste materials.

The containers of the present invention, while preferably being essentially square, can be round, rectangular or another shape. Preferably, the volume of the container is determined by the height of the container. For example a 30" by 30" by 46" container with tapered sidewalls would contain approximately 1 cubic yard of material. To provide smaller containers yet still maintain stackability, all the containers would have the same top opening size and have the same bottom size but be of varying height and taper to provide, for example, a half yard container, a third yard container, or a quarter yard container. Such containers, having tapered sidewalls would also be nestable, one within another, when empty, to minimize space requirements prior to use. Of course, larger containers are also contemplated as being within the scope of the invention. Thus, both the small and large solid waste generators would be able to take advantage of the inventive stackable solid waste container system.

While particular embodiments have been shown and described, it will be understood by those skilled in the art that the invention is not limited to only the preferred embodiments and that various changes and modifications could be made without varying from the scope of the present invention. For example, various valve types, container materials of construction, pressure sensor means or means for sealing the lid to the container can be used without varying from the scope of the present invention.

What is claimed is:

1. A waste container comprising:

a container body having an open top;

lid means disposable on the top;

means for sealing the lid to the container body; and means for evacuating air from the sealed container, comprising a passage, extending through the container body or lid, filter means disposed inwardly of the passage within the container and flow reversal prevention means located downstream in the passage from the filter, the flow reversal prevention means allowing air to be withdrawn from the container and preventing air from reentering the container through the passage.

2. The container of claim 1 wherein the container body has a bottom, having a plurality of slots sized for accepting the forks of a fork truck or hand truck therein.

3. The container of claim 1 wherein the container body has sidewalls, and the lid and sidewalls have grooves which are alignable, and further comprising straps disposable in the grooves for securing the lid to the container.

4. The container of claim 1 further comprising an opening in the container body or lid, and pressure sensing means disposed in the opening.

5. The container of claim 4 wherein the pressure sensing means is a grommet having a deformable membrane therein, the membrane being convex when the container is at atmospheric pressure, and being concave when the container is under vacuum.

6. The container of claim 1 wherein the container body and lid are composed of plastic.

7. The container of claim 6 wherein the plastic is from the group consisting essentially of polyethylene, polyvinylchloride, nylon, polycarbonate and polyester.

8. The container of claim 1 wherein the filter means comprises a high efficiency particulate air filter having a removal efficiency rating of 5 micron to 99 plus percent.

9. The container of claim 1 wherein the flow reversal prevention means comprises a ball check valve, a flap check valve or a collapsible rubber check valve.

10. The container of claim 1 wherein the container body is round, square, or rectangular.

11. The container of claim 1 wherein the lid includes a plurality of sockets, and the container bottom includes a plurality of projections, the projections and sockets being so positioned as to be matable for stabilized stacking of a second container on the first container.

12. The container of claim 1 further comprising a seal disposable on a lid of the container for sealing the lid to the container.

* * * * *